United States Patent [19]

Schiel

[11] Patent Number: 4,576,681

[45] Date of Patent: Mar. 18, 1986

[54] MACHINE FOR MAKING A FIBER WEB WITH SHARPLY DEFINED EDGES

[75] Inventor: Christian Schiel, Heidenheim, Fed. Rep. of Germany

[73] Assignee: J. M. Voith GmbH, Heidenheim, Fed. Rep. of Germany

[21] Appl. No.: 634,689

[22] Filed: Jul. 26, 1984

[30] Foreign Application Priority Data

Jul. 27, 1983 [DE] Fed. Rep. of Germany ..... 3327056

[51] Int. Cl.[4] ..... D21F 1/00

[52] U.S. Cl. ..... 162/301; 162/317; 162/346; 162/353

[58] Field of Search ..... 162/301, 315, 316, 317, 162/318, 319, 320, 321, 336, 337, 338, 339, 344, 345, 346, 347, 353, 286

[56] References Cited

U.S. PATENT DOCUMENTS

| | | | |
|---|---|---|---|
| 3,224,928 | 12/1965 | Lee et al. | 162/214 |
| 3,470,063 | 9/1969 | Sanford | 162/303 |
| 3,652,390 | 3/1972 | Peterson | 162/303 |
| 4,124,441 | 11/1978 | Nykopp | 162/317 |
| 4,234,382 | 11/1980 | Schiel | 162/317 |
| 4,456,502 | 6/1984 | Bollani | 162/353 |
| 4,478,684 | 10/1984 | Kochndörfer et al. | 162/336 |

*Primary Examiner*—S. Leon Bashore
*Assistant Examiner*—K. M. Hastings
*Attorney, Agent, or Firm*—Albert L. Jeffers; Stephen T. Belsheim

[57] ABSTRACT

A machine for making a fiber web with sharply defined edges, specifically a paper or tissue web, between a felt and a wire, features a headbox that dispenses the fiber suspension into a feed-in area formed between the felt and wire. The wire has a smaller width than the width of the fiber suspension stream dispensed by the headbox.

3 Claims, 2 Drawing Figures

MACHINE FOR MAKING A FIBER WEB WITH SHARPLY DEFINED EDGES

BACKGROUND OF THE INVENTION

The invention relates to a machine for making a fiber web with sharply defined edges, specifically a paper or tissue web, between a felt and a wire; said machine features a headbox that dispenses the fiber suspension into a feed-in area formed between the felt and the wire.

Typically, the paper web formed by paper machines is normally made oversize in the width or lateral dimension. The irregular thin edges of the finished web are then trimmed off and recycled to the stock preparation system of the machine. However, sharply defined edges can also be made by separating the edges from the wet web by means of a thin jet of water.

An example of the above type machine is disclosed in German Patent Publication No. 15 61 669 wherein an attempt is made at obtaining sharp web edges by providing in the web forming wire a small sealed band near each edge of the wire whereby the wire is impermeable over a slight width at each edge. Thus, no web formation occurs on these sealed bands and the edge strips produced outside of the sealed bands are not connected with the web. A drawback with this type of machine is that the edge strips, which are already separated in the web formation zone, will be picked up by the receiving felt and carried through the machine and can been discarded only after the first drying cylinder. Consequently, part of the machine width and energy is unnecessarily used for handling the already-separated edge strips.

SUMMARY OF THE INVENTION

An object of the present invention is to provide a machine wherein the formation of separate edge strips is eliminated and a fiber web with sharply defined edges is produced.

This object is obtained by the present invention by providing a wire having a width less than the width of the fiber suspension stream dispensed by the headbox. Thus, only a web having the width of the wire is formed between the wire and felt. The part of the fiber suspension stream dispensed beyond the wire width is removed together with the white water. On machines operating at a sufficiently high speed, it has been demonstrated that a web produced in accordance with the present invention is of uniform thickness and is sharply defined to the outer edges thereof. Moreover, the machine for producing such a web can be reduced in dimension and operated at an energy level less than the above-mentioned current machine.

To further ensure the uniform and sharp properties of the produced paper web in accordance with the present invention, it is preferred that the wire have uniform drainage properties across its width or lateral dimension all the way to the edges.

BRIEF DESCRIPTION OF THE DRAWINGS

The above-mentioned and other features and objects of this invention, and the manner of attaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
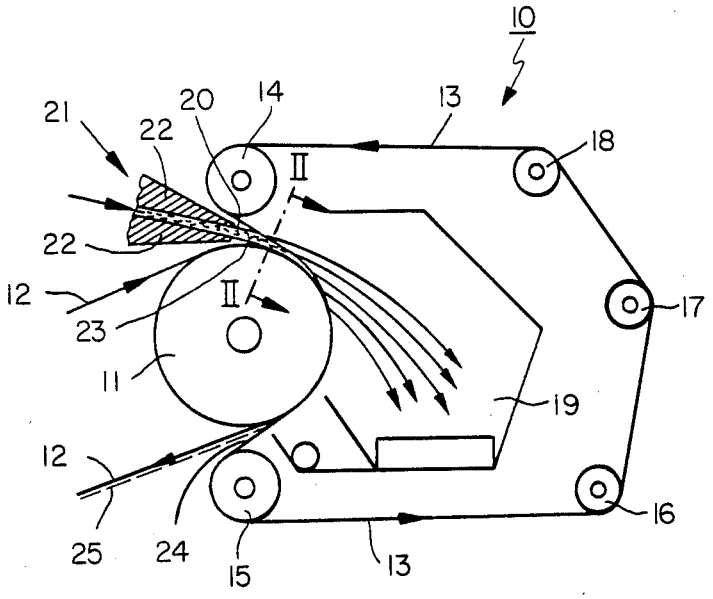
FIG. 1 is a schematic view of a preferred embodiment of the present invention.

Referring to the Figures, webforming section 10 of an otherwise unillustrated paper machine features a forming roll 11 around a part of which loops a moving endless felt 12. Also provided is a moving endless wire 13, which also loops around forming roll 11 while making contact with the outside portion of felt 12. Wire 13 runs over a number of guide rolls 14-18, and a water pan 19 is arranged inside wire 13 and receives white water from the drainage area at forming roll 11.

Felt 12 loops around approximately one-half the circumference of forming roll 11, and wire 13 loops around a smaller fractional portion of the circumference of roll 11. Felt 12 and wire 13 form therebetween a feed-in area 20 that cooperates with forming roll 11. Headbox 21 having lips 22 protrudes into area 20 for dispensing a fiber suspension stream 23 between felt 12 and wire 13. The tension of wire 13 causes a pressure against felt 12 resulting in water removal from the suspension through wire 13. The removed water is thrown off through centrifugal force, collected in pan 19, and returned to the pulp circulation of the machine. At exit area 24 of forming roll 11, wire 13 is separated from felt 12, and paper web 25 continues to adhere to felt 12. Paper web 25 runs on felt 12 through further dewatering stations (not shown) of the machine and is then reeled after drying.

Figure 2:
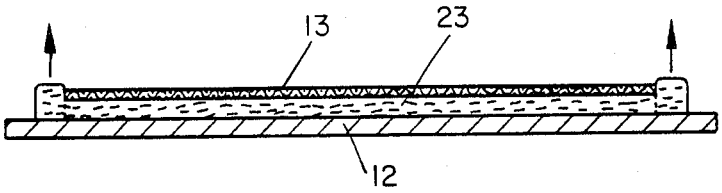
FIG. 2 is a sectional view of FIG. 1 taken along line II—II and viewed in the direction of the arrows.

As can be seen in FIG. 1, felt 12 has a greater width than the width of fiber suspension stream 23 dispensed by headbox 21, and wire 13 has a smaller or narrower width than the width of stream 23. Consequently, the portion of the fiber suspension stream 23 not covered by wire 13 will be thrown off felt 12 in the direction of the arrows and returned to the pulp circulation along with the white water. Because of the extremely rapid drainage of the fiber suspension on forming roll 11 and the drainage properties of wire 13, which are uniform across its width or lateral dimension, paper web 25 is produced with straight sharply defined edges. As can be seen in FIGS. 1 and 2, the dehydration zone is free of sidewalls for sideways limitation of the fiber suspension. The edges of the fiber suspension are removed solely by centrifugal force.

It is further contemplated that the present invention can be utilized on machines, such as that disclosed in U.S. Pat. No. 3,224,928, where the felt and wire continue after the entering area over a certain distance in a straight line with the fiber suspension therebetween. In this area, other additional suction elements are provided for dewatering of the web.

While this invention has been described as having a preferred embodiment, it will be understood that it is capable of further modifications. This application is therefore intended to cover any variations, uses, adaptations of the invention following the general principles thereof, and including such departures from the present disclosure as come within known or customary practice in the art to which this invention pertains and fall within the limits of the appended claims.

What is claimed is:

1. In a machine for producing a fiber web between a felt member and a wire member, and including a headbox for dispensing a fiber suspension stream of a selected width into a feed-in area formed between said felt member and said wire member, the improvement comprising said felt member directly loops a portion of the circumference of a forming roll, said wire member directly loops a portion of that portion of the felt member that loops the forming roll so as to define a curved dehydration zone between the felt member and wire member, said wire member having a width less than the width of the fiber suspension stream being dispensed by said headbox and the width of the felt member so that in the area of the dehydration zone there is produced a fiber web having sharply defined lateral edges, and the dehydration zone is free of side walls for sideways limitation of the fiber suspension.

2. The machine of claim 1 wherein said wire member is structured so that it has uniform drainage properties substantially across its width.

3. In a machine for producing a fiber web between a felt member and a wire member wherein the felt member directly loops a portion of the circumference of the forming roll and the wire member directly loops a portion of the felt member that loops the forming roll, and including a headbox for dispensing a fiber suspension stream of a selected width into a curved feed-in area formed between said felt member and said wire member prior to the wire member looping the felt member, the improvement comprising said wire member having a width less than the width of the fiber suspension stream being dispensed by said headbox and the width of the felt member so that the edges of the fiber suspension on the felt member are removed solely by centrifugal force thereby producing a fiber web having sharply defined lateral edges.

* * * * *